US008823634B2

(12) United States Patent
Suzuki et al.

(10) Patent No.: US 8,823,634 B2
(45) Date of Patent: Sep. 2, 2014

(54) LIQUID CRYSTAL DISPLAY DEVICE

(71) Applicants: Daiichi Suzuki, Nonoichi (JP); Kenji Nakao, Kanazawa (JP); Kazuhiro Nishiyama, Kanazawa (JP); Emi Higano, Nonoichi (JP)

(72) Inventors: Daiichi Suzuki, Nonoichi (JP); Kenji Nakao, Kanazawa (JP); Kazuhiro Nishiyama, Kanazawa (JP); Emi Higano, Nonoichi (JP)

(73) Assignee: Japan Display Inc., Tokyo (JP)

( * ) Notice: Subject to any disclaimer, the term of this patent is extended or adjusted under 35 U.S.C. 154(b) by 101 days.

(21) Appl. No.: 13/684,794

(22) Filed: Nov. 26, 2012

(65) Prior Publication Data

US 2013/0135187 A1 May 30, 2013

(30) Foreign Application Priority Data

Nov. 29, 2011 (JP) ..... 2011-260649

(51) Int. Cl.
*G09G 3/36* (2006.01)
*G09G 3/34* (2006.01)
*G09G 3/00* (2006.01)

(52) U.S. Cl.
CPC ..... *G09G 3/3648* (2013.01); *G09G 2320/028* (2013.01); *G09G 3/3406* (2013.01); *G09G 2300/023* (2013.01); *G09G 2330/021* (2013.01); *G09G 3/003* (2013.01)
USPC ..... 345/102; 345/211

(58) Field of Classification Search
CPC ..... G09G 3/3406; G09G 3/3648; G09G 2300/023; G09G 2338/028; G09G 2300/021
USPC ..... 345/6, 102, 211, 212
See application file for complete search history.

(56) References Cited

U.S. PATENT DOCUMENTS

2013/0120474 A1* 5/2013 Suzuki et al.
2013/0207955 A1* 8/2013 Kim et al. ..... 345/212
2013/0235019 A1* 9/2013 Kim et al. ..... 345/212
2013/0321482 A1* 12/2013 Goro et al.

FOREIGN PATENT DOCUMENTS

JP 2006-10935 1/2006

* cited by examiner

*Primary Examiner* — Regina Liang
(74) *Attorney, Agent, or Firm* — Oblon, Spivak, McClelland, Maier & Neustadt, L.L.P.

(57) ABSTRACT

According to one embodiment, a liquid crystal display device includes a liquid crystal display panel, a first illumination unit configured to illuminate the liquid crystal display panel with light which is emitted in a first emission direction, a second illumination unit configured to illuminate the liquid crystal display panel with light which is emitted in a second emission direction different from the first emission direction, and a controller configured to control the liquid crystal display panel, the first illumination unit and the second illumination unit in a first display mode in which 3D display with power saving is effected, and in a second display mode in which 3D display with a wider viewing angle than in the first display mode is effected.

7 Claims, 3 Drawing Sheets

LIQUID CRYSTAL DISPLAY DEVICE

CROSS-REFERENCE TO RELATED APPLICATIONS

This application is based upon and claims the benefit of priority from Japanese Patent Application No. 2011-260649, filed Nov. 29, 2011, the entire contents of which are incorporated herein by reference.

FIELD

Embodiments described herein relate generally to a liquid crystal display device.

BACKGROUND

By virtue of such features as light weight, small thickness and low power consumption, liquid crystal display devices have been used in various fields as display devices of OA equipment, such as personal computers, and TVs. In recent years, liquid crystal display devices have also been used as display devices of portable terminal equipment such as mobile phones, car navigation apparatuses, amusement devices, etc.

Of such liquid crystal display devices, a liquid crystal display device, which is configured to include an illumination unit (i.e. backlight) on a back side of a liquid crystal display panel, is required to have a higher brightness and a higher display quality. In recent years, as the illumination unit mounted in the liquid crystal display device, there has been proposed an illumination unit having such a directivity that light can be emitted in at least two directions.

DETAILED DESCRIPTION

Figure 1:
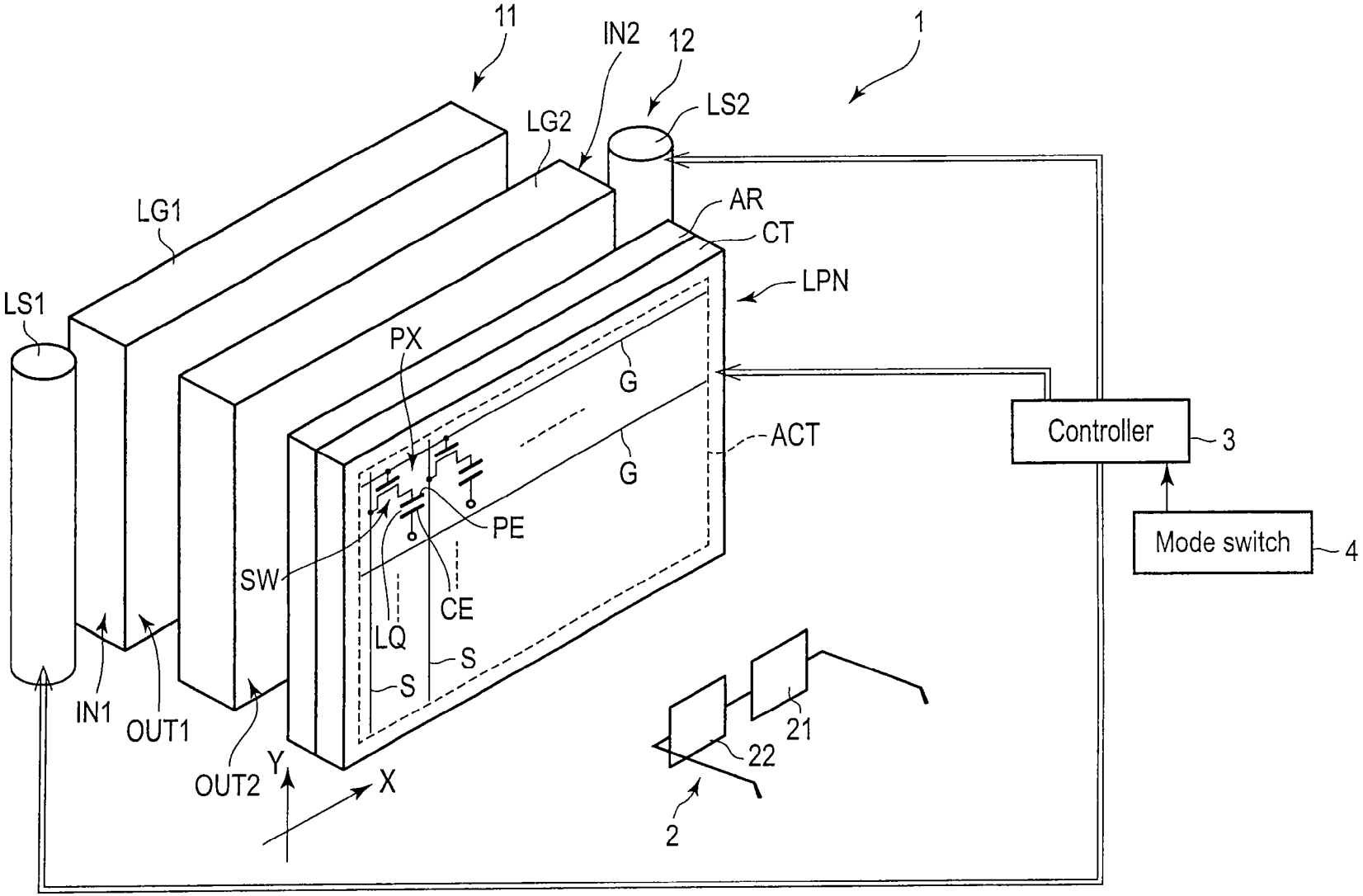
FIG. 1 is an exploded perspective view which schematically illustrates a structure example of a liquid crystal display device according to an embodiment.

In general, according to one embodiment, a liquid crystal display device includes: a liquid crystal display panel of a transmission type; a first illumination unit configured to illuminate the liquid crystal display panel with light which is emitted in a first emission direction with an inclination to a normal of the liquid crystal display panel; a second illumination unit configured to illuminate the liquid crystal display panel with light which is emitted in a second emission direction with an inclination to the normal of the liquid crystal display panel, the second emission direction being different from the first emission direction; and a controller configured to control the liquid crystal display panel, the first illumination unit and the second illumination unit in a first display mode in which 3D display with power saving is effected, and in a second display mode in which 3D display with a wider viewing angle than in the first display mode is effected, the controller being configured to execute the first display mode in which the controller alternately outputs a left-eye video signal and a right-eye video signal to the liquid crystal display panel in a state in which a right-eye shutter and a left-eye shutter of shutter glasses are opened at the same time, turns on the first illumination unit and turns off the second illumination unit when the left-eye video signal is output to the liquid crystal display panel, and turns on the second illumination unit and turns off the first illumination unit when the right-eye video signal is output to the liquid crystal display panel, and the controller being configured to execute the second display mode in which the controller alternately outputs the left-eye video signal and the right-eye video signal to the liquid crystal display panel in synchronism with alternate opening/closing of the right-eye shutter and the left-eye shutter of the shutter glasses, and turns on the first illumination unit and the second illumination unit at the same time.

Embodiments will now be described in detail with reference to the accompanying drawings. In the drawings, structural elements having the same or similar functions are denoted by like reference numerals, and an overlapping description is omitted.

FIG. 1 is an exploded perspective view which schematically illustrates a structure example of a liquid crystal display device 1 according to an embodiment.

The liquid crystal display device 1, which will be described in this embodiment, is configured to be able to display a 3D image. The liquid crystal display device 1 includes a liquid crystal display panel LPN of a transmission type, which has a substantially rectangular plate shape, and a first illumination unit 11 and a second illumination unit 12 which illuminate the liquid crystal display panel LPN. In the example illustrated, the first illumination unit 11, second illumination unit 12 and liquid crystal display panel LPN are stacked in the named order.

The liquid crystal display panel LPN is configured such that a liquid crystal layer is held between a pair of substrates. Specifically, the liquid crystal display panel LPN includes an array substrate AR and a counter-substrate CT each having a substantially rectangular plate shape, and a liquid crystal layer LQ which is sealed between the array substrate AR and a counter-substrate CT. The liquid crystal display panel LPN includes a substantially rectangular active area (display area) ACT which displays an image. The active area ACT is composed of a plurality of pixels PX which are arrayed in a matrix.

The active area ACT includes a plurality of gate lines G extending in a first direction X, a plurality of source lines S extending in a second direction Y which crosses the first direction X, a switching element SW which is disposed in each pixel PX and is electrically connected to the gate line G and source line S, a pixel electrode PE which is connected to the switching element SW of each pixel PX, and a common electrode CE which is disposed common to a plurality of pixel electrodes PE. The gate lines G, source lines S, switching elements SW and pixel electrodes PE are provided on the array substrate AR. The pixel electrodes PE and common electrode CE are formed of a light-transmissive electrically conductive material such as indium tin oxide (ITO) or indium zinc oxide (IZO). The common electrode CE for applying a voltage to the liquid crystal layer LQ by a potential difference between the common electrode CE and the pixel electrode PE may be provided on the array substrate AR together with the pixel electrode PE, or may be provided on the counter-substrate CT separately from the pixel electrode PE.

In the meantime, in the liquid crystal display panel LPN, an optical element including a polarizer is provided on an outer surface of the array substrate AR. Similarly, an optical element including a polarizer is provided on an outer surface of the counter-substrate CT. The depiction of these optical elements is omitted.

The first illumination unit 11 includes a first light guide LG1 and a first light source LS1. The second illumination unit 12 includes a second light guide LG2 and a second light source LS2.

The first light guide LG1 is disposed on a back side of the liquid crystal display panel LPN, that is, on the side facing the array substrate AR. The first light guide LG1 has a first incidence surface IN1 and a first emission surface OUT1. The second light guide LG2 is stacked on the first light guide LG1. In the example illustrated, the second light guide LG2 is disposed between the first light guide LG1 and the liquid crystal display panel LPN. The second light guide LG2 has a second incidence surface IN2 and a second emission surface OUT2.

Like the liquid crystal display panel LPN, each of the first light guide LG1 and second light guide LG2 is formed in a substantially rectangular plate shape, and is rectangular with a long side in the first direction X and a short side in the second direction Y in the X-Y plane. In the meantime, the first incidence surface IN1 is formed along one short side of the first light guide LG1, and the second incidence surface IN2 is formed along one short side of the second light guide LG2. Each of the first emission surface OUT1 and second emission surface OUT2 is rectangular with a greater length in the first direction X than in the second direction Y.

The first light source LS1 is disposed along the short side of the first light guide LG1, and is disposed to face the first incidence surface IN1. The second light source LS2 is disposed along the short side of the second light guide LG2, and is disposed to face the second incidence surface IN2. The position of disposition of the first light source LS1 is opposite to the position of disposition of the second light source LS2, with the liquid crystal display panel LPN being interposed. Specifically, the first light source LS1 is disposed at a position not overlapping the second light source LS2. Each of the first light source LS1 and second light source LS2 may be a plurality of light-emitting diodes (LEDs) which are arranged along the second direction Y, or may be a cold cathode fluorescent lamp (CCFL) which extends along the second direction Y. Incidentally, it is desirable that the first light source LS1 and second light source LS2 be surrounded by a reflector (not shown).

Although not shown, various kinds of optical films are disposed between the liquid crystal display panel LPN and the second light guide LG2. In addition, optical films may be disposed between the first light guide LG1 and second light guide LG2.

Shutter glasses 2, which are usable when observing the liquid crystal display device 1, includes a right-eye shutter 21 and a left-eye shutter 22. The right-eye shutter 21 and left-eye shutter 22 are shutters, such as liquid crystal shutters, which optically pass light ("open state") or block light ("closed state").

A controller 3 controls the liquid crystal display panel LPN, first illumination unit 11 and second illumination unit 12. In the meantime, the controller 3 can be connected to the shutter glasses 2 by wire or wirelessly. Specifically, the controller 3 controls the liquid crystal display panel LPN, first illumination unit 11 and second illumination unit 12 in accordance with an operation state of the shutter glasses 2 or a mode set by the shutter glasses 2, or controls the liquid crystal display panel LPN, first illumination unit 11 and second illumination unit 12 and controls the shutter glasses 2, in accordance with, for example, a mode set by a mode setting module which is provided separately from the shutter glasses 2.

To be more specific, when 3D display is effected, the controller 3 alternately outputs a left-eye video signal and a right-eye video signal to the liquid crystal display panel LPN. In addition, where necessary, the controller 3 controls turn-on and turn-off of the first light source LS1 of the first illumination unit 11, and controls turn-on and turn-off of the second light source LS2 of the second illumination unit 12. Besides, where necessary, the controller 3 controls opening/closing of the right-eye shutter 21 and opening/closing of the left-eye shutter 22 of the shutter glasses 2.

Figure 2:
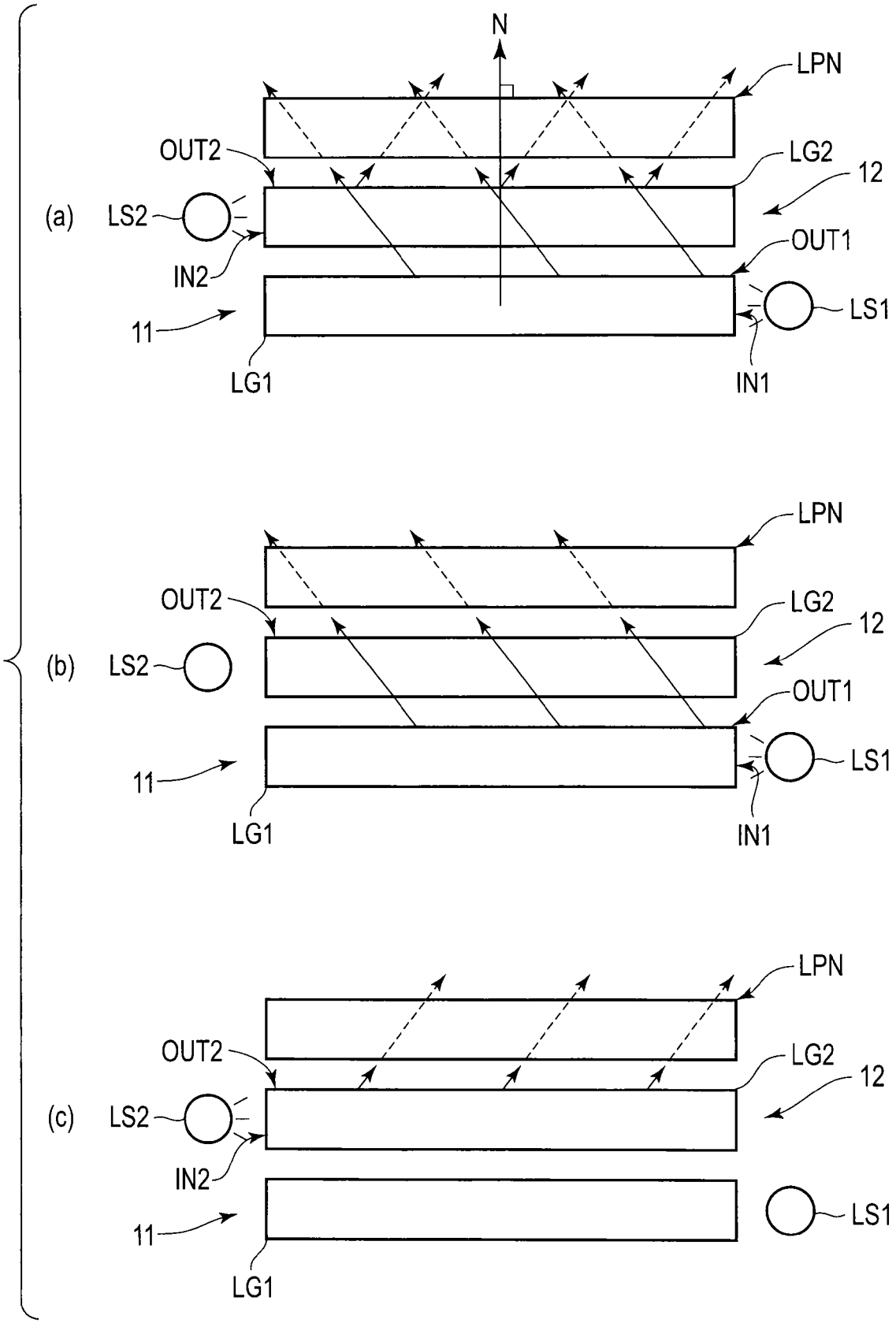
FIG. 2 is a view for explaining a configuration example of a first illumination unit and a second illumination unit, which are applicable to the liquid crystal display device of the embodiment.

FIG. 2 is a view for explaining a configuration example of the first illumination unit 11 and second illumination unit 12, which are applicable to the liquid crystal display device 1 of the embodiment.

The first light guide LG1 and second light guide LG2 are configured to emit light in different directions. In the example illustrated, in the first illumination unit 11, light, which is incident on the first incidence surface IN1 of the first light guide LG1 from the first light source LS1, is emitted from the first emission surface OUT1 in a first emission direction (leftward in FIG. 2) with an inclination to a normal N of the liquid crystal display panel LPN. On the other hand, in the second illumination unit 12, light, which is incident on the second incidence surface IN2 of the second light guide LG2 from the second light source LS2, is emitted from the second emission surface OUT2 in a second emission direction (rightward in FIG. 2) with an inclination to the normal N of the liquid crystal display panel LPN. The first emission direction of the light from the first emission surface OUT1 is opposite to the second emission direction of the light from the second emission surface OUT2 with respect to the normal N.

Part (a) of FIG. 2 corresponds to a state in which while the controller 3 alternately outputs a left-eye video signal and a right-eye video signal to the liquid crystal display panel LPN, the first light source LS1 and second light source LS2 are turned on at the same time. The first illumination unit 11 emits light, which is incident on the first light guide LG1 from the first light source LS1, from the first emission surface OUT1 toward the left in FIG. 2, and illuminates the liquid crystal display panel LPN via the second light guide LG2. At the same time, the second illumination unit 12 emits light, which is incident on the second light guide LG2 from the second light source LS2, from the second emission surface OUT2 toward the right in FIG. 2, and illuminates the liquid crystal display panel LPN. The liquid crystal display panel LPN selectively passes the light from the first illumination unit 11 and the light from the second illumination unit 12 in accordance with video signals, thereby displaying images.

Part (b) of FIG. 2 corresponds to a state in which while the controller 3 outputs a left-eye video signal or a right-eye video signal to the liquid crystal display panel LPN, the first light source LS1 alone is turned on and the second light source LS2 is turned off. The first illumination unit 11 emits light, which is incident on the first light guide LG1 from the first light source LS1, from the first emission surface OUT1 toward the left side in FIG. 2, and illuminates the liquid crystal display panel LPN. At this time, since the second light source LS2 is turned off, the liquid crystal display panel LPN is not illuminated by the second illumination unit 12. The liquid crystal display panel LPN selectively passes the light from the first illumination unit 11 in accordance with video signals, thereby displaying images.

For example, in the case where the liquid crystal display panel LPN is illuminated by only the first illumination unit 11 at a timing when the controller 3 outputs the left-eye video signal to the liquid crystal display panel LPN, the light from the first illumination unit 11 selectively passes through the liquid crystal display panel LPN toward the left eye of the observer.

Part (c) of FIG. 2 corresponds to a state in which while the controller 3 outputs a left-eye video signal or a right-eye video signal to the liquid crystal display panel LPN, the second light source LS2 alone is turned on and the first light source LS1 is turned off. The second illumination unit 12 emits light, which is incident on the second light guide LG2 from the second light source LS2, from the second emission surface OUT2 toward the right side in FIG. 2, and illuminates the liquid crystal display panel LPN. At this time, since the first light source LS1 is turned off, the liquid crystal display panel LPN is not illuminated by the first illumination unit 11. The liquid crystal display panel LPN selectively passes the light from the second illumination unit 12 in accordance with video signals, thereby displaying images.

For example, in the case where the liquid crystal display panel LPN is illuminated by only the second illumination unit 12 at a timing when the controller 3 outputs the right-eye video signal to the liquid crystal display panel LPN, the light from the second illumination unit 12 selectively passes through the liquid crystal display panel LPN toward the right eye of the observer.

Figure 3:
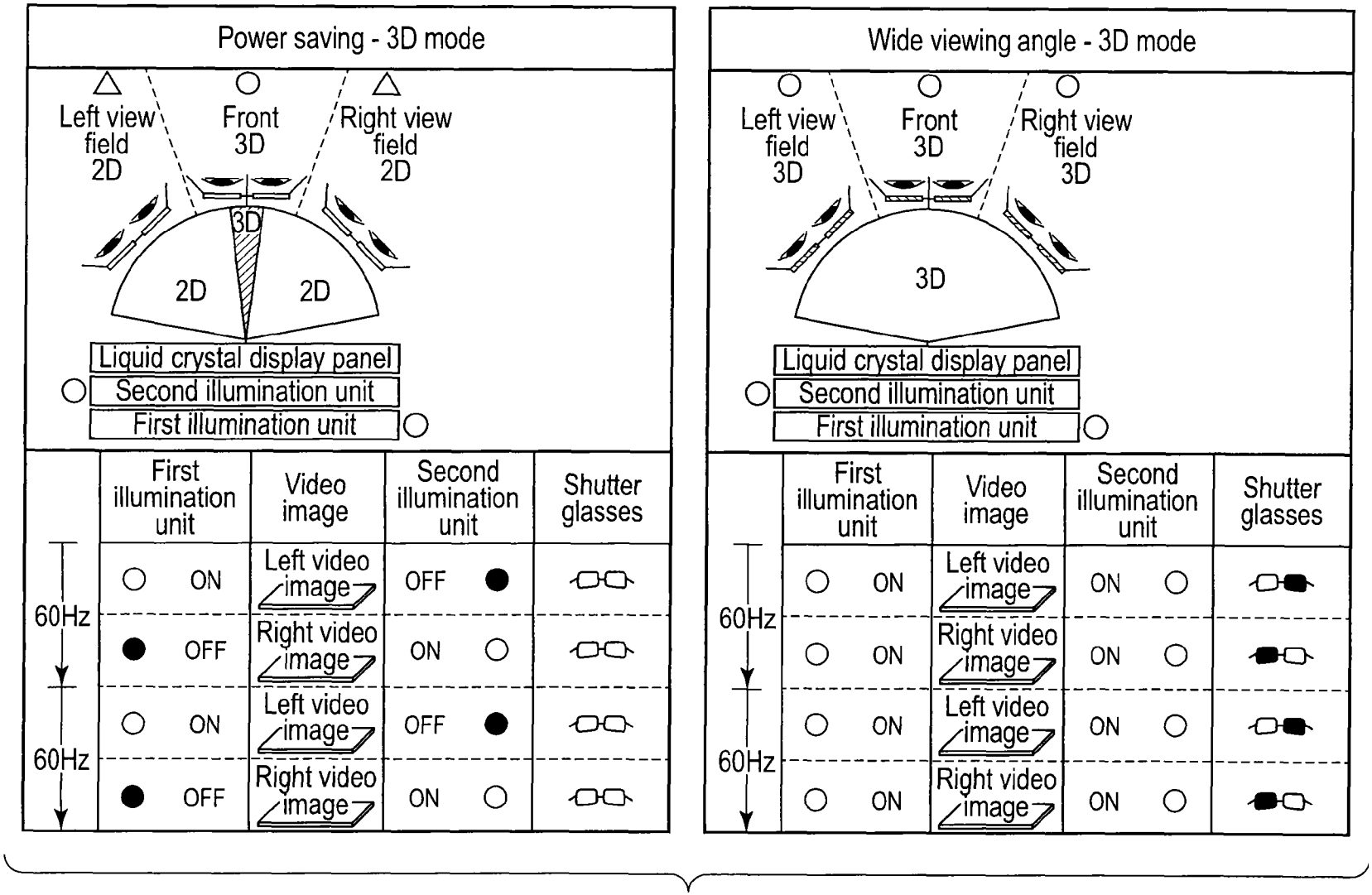
FIG. 3 is a view for explaining an operation example of the liquid crystal display device shown in FIG. 1.

FIG. 3 is a view for explaining an operation example of the liquid crystal display device 1 shown in FIG. 1.

As illustrated in FIG. 3, the liquid crystal display device 1 is configured such that an observer who wears the shutter glasses 2 can observe 3D display (stereoscopic display), and the liquid crystal display device 1 can perform switch-over display between a first display mode in which 3D display with power saving is effected, and a second display mode in which 3D display with a wide viewing angle is effected. In the example illustrated in FIG. 1, the liquid crystal display device 1 includes a mode switch 4 for effecting switching between at least the first display mode and the second display mode. Incidentally, the mode switch 4 may be provided in the shutter glasses 2.

For example, when the first display mode has been set by the mode switch 4, the controller 3 executes the first display mode. In the first display mode, the controller 3 alternately outputs a left-eye video signal and a right-eye video signal to the liquid crystal display panel LPN. In addition, the controller 3 turns on (ON) the first illumination unit 11 and turns off (OFF) the second illumination unit 12 when the left-eye video signal is output to the liquid crystal display panel LPN, and the controller 3 turns on (ON) the second illumination unit 12 and turns off (OFF) the first illumination unit 11 when the right-eye video signal is output to the liquid crystal display panel LPN. Specifically, in the first display mode, the liquid crystal display panel LPN is alternately illuminated by the first illumination unit 11 and second illumination unit 12.

In the meantime, the state in which the first illumination unit 11 is turned on corresponds to the state in which the first light source LS1 is turned on. The state in which the second illumination unit 12 is turned on corresponds to the state in which the second light source LS2 is turned on. The left-eye video signal and the right-eye video signal are alternately output to the liquid crystal display panel LPN, for example, at a frequency of 60 Hz. In addition, the ON/OFF switching of the first illumination unit 11 and the ON/OFF switching of the second illumination unit 12 are alternately executed at 60 Hz in synchronism with the output of the left-eye video signal and the right-eye video signal.

The operation state of the shutter glasses 2 during the execution of the first display mode may be set on the side of the shutter glasses 2, or may be set by the controller 3. In the first display mode, in the shutter glasses 2, both the right-eye shutter 21 and left-eye shutter 22 are always in the open state.

When the operation state of the shutter glasses 2 has been set on the side of the shutter glasses 2, the controller 3 executes the first display mode in the state in which both the right-eye shutter 21 and left-eye shutter 22 are opened at the same time. In the case where the operation state of the shutter glasses 2 is controlled on the side of the controller 3, the controller 3 outputs, in accordance with the execution of the first display mode, a control signal for simultaneously opening the right-eye shutter 21 and left-eye shutter 22 to the shutter glasses 2.

In this first display mode, 3D display is observed in a viewing angle range of an area including a normal direction of the liquid crystal display panel LPN. In a viewing angle range with a large inclination from the normal direction of the liquid crystal display panel LPN, only a left-eye video image or a right-eye video image is observed, and substantially 2D display (planar display) is observed.

In addition, in the first display mode, in accordance with the alternate input of the left-eye video signal and right-eye video signal to the liquid crystal display panel LPN, the first illumination unit 11, which emits light with a leftward directivity, and the second illumination unit 12, which emits light with a rightward directivity, are alternately turned on. Thus, the power consumption of the liquid crystal display device 1 including the first illumination unit 11 and second illumination unit 12 can be reduced.

In the above-described first display mode, however, since the left-eye video image and right-eye video image are displayed with their respective directivities in a time-division manner, 3D display can be observed in the viewing angle range of the area including the normal direction of the liquid crystal display panel LPN, even without wearing the shutter glasses 2 ("naked-eye time-division 3D display mode").

On the other hand, for example, when the second display mode has been set by the mode switch 4, the controller 3 executes the second display mode. In the second display mode, the controller 3 alternately outputs a left-eye video signal and a right-eye video signal to the liquid crystal display panel LPN, and turns on the first illumination unit 11 and the second illumination unit 12 at the same time. Specifically, in the second display mode, the liquid crystal display panel LPN is illuminated by both the first illumination unit 11 and second illumination unit 12.

The operation state of the shutter glasses 2 during the execution of the second display mode may be set on the side of the shutter glasses 2, or may be set by the controller 3. In the second display mode, in the shutter glasses 2, the right-eye shutter 21 and left-eye shutter 22 are alternately set in the open state.

When the operation state of the shutter glasses 2 has been set on the side of the shutter glasses 2, the controller 3 executes the second display mode by alternately outputting the left-eye video signal and the right-eye video signal to the liquid crystal display panel LPN in synchronism with alternate opening/closing of the right-eye shutter 21 and left-eye shutter 22. Specifically, the controller 3 outputs the left-eye video signal to the liquid crystal display panel LPN in synchronism with the timing when the left-eye shutter 22 is in the open state and the right-eye shutter 21 is in the closed state. In addition, the controller 3 outputs the right-eye video signal to the liquid crystal display panel LPN in synchronism with the timing when the right-eye shutter 21 is in the open state and the left-eye shutter 22 is in the closed state.

In the case where the operation state of the shutter glasses 2 is controlled on the side of the controller 3, the controller 3 executes the second display mode by alternately outputting the left-eye video signal and right-eye video signal to the liquid crystal display panel LPN, and outputting a control signal to the shutter glasses 2. Specifically, in synchronism with the timing of outputting the left-eye video signal to the liquid crystal display panel LPN, the controller 3 outputs a control signal for opening the left-eye shutter 22 and closing the right-eye shutter 21 to the shutter glasses 2. In addition, in synchronism with the timing of outputting the right-eye video signal to the liquid crystal display panel LPN, the controller 3 outputs a control signal for opening the right-eye shutter 21 and closing the left-eye shutter 22 to the shutter glasses 2.

In this second display mode, while the left-eye video signal and right-eye video signal are alternately input to the liquid crystal display panel LPN, the first illumination unit 11, which emits light with a leftward directivity, and the second illumination unit 12, which emits light with a rightward directivity, are turned on at the same time. Thus, the left-eye video image and right-eye video image are alternately displayed in a time-division manner in the viewing angle range of almost all directions including the normal direction of the liquid crystal display panel LPN. Therefore, 3D display can be observed over a wide viewing angle range via the shutter glasses 2 which open and close in sync with video signals, and it is possible to suppress such 3D crosstalk that a left-eye video image and a right-eye video image are observed in a mixed state from one of the shutters of the shutter glasses 2, and to realize high-quality 3D display.

The switching between the first display mode and the second display mode, which have been described above, can be executed in the state in which the shutter glasses 2 are worn, and troublesomeness in putting on and taking off the shutter glasses 2 can be eliminated.

As has been described above, according to the present embodiment, a liquid crystal display device, which can reduce power consumption and realize high-quality 3D display, can be provided.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid crystal display device comprising:

a liquid crystal display panel of a transmission type;

a first illumination unit configured to illuminate the liquid crystal display panel with light which is emitted in a first emission direction with an inclination to a normal of the liquid crystal display panel;

a second illumination unit configured to illuminate the liquid crystal display panel with light which is emitted in a second emission direction with an inclination to the normal of the liquid crystal display panel, the second emission direction being different from the first emission direction; and a controller configured to control the liquid crystal display panel, the first illumination unit and the second illumination unit in a first display mode in which 3D display with power saving is effected, and in a second display mode in which 3D display with a wider viewing angle than in the first display mode is effected, the controller being configured to execute the first display mode in which the controller alternately outputs a left-eye video signal and a right-eye video signal to the liquid crystal display panel in a state in which a right-eye shutter and a left-eye shutter of shutter glasses are opened at the same time, turns on the first illumination unit and turns off the second illumination unit when the left-eye video signal is output to the liquid crystal display panel, and turns on the second illumination unit and turns off the first illumination unit when the right-eye video signal is output to the liquid crystal display panel, and the controller being configured to execute the second display mode in which the controller alternately outputs the left-eye video signal and the right-eye video signal to the liquid crystal display panel in synchronism with alternate opening/closing of the right-eye shutter and the left-eye shutter of the shutter glasses, and turns on the first illumination unit and the second illumination unit at the same time.

2. The liquid crystal display device of claim 1, wherein the controller is configured to output, in the first display mode, a control signal for simultaneously opening the right-eye shutter and the left-eye shutter of the shutter glasses.

3. The liquid crystal display device of claim 1, wherein the controller is configured to output, in the second display mode, a control signal for opening the left-eye shutter and closing the right-eye shutter in synchronism with outputting the left-eye video signal to the liquid crystal display panel, and a control signal for opening the right-eye shutter and closing the left-eye shutter in synchronism with outputting the right-eye video signal to the liquid crystal display panel.

4. The liquid crystal display device of claim 1, further comprising a mode switch configured to effect switching between the first display mode and the second display mode.

5. The liquid crystal display device of claim 1, wherein the first illumination unit includes a first light guide with a first incidence surface and a first emission surface, and a first light source located on a side facing the first incidence surface, and is configured such that light, which is incident on the first light guide is emitted from the first emission surface in the first emission direction, and the second illumination unit includes a second light guide with a second incidence surface and a second emission surface, and a second light source located on a side facing the second incidence surface, and is configured such that light, which is incident on the second light guide is emitted from the second emission surface in the second emission direction.

6. The liquid crystal display device of claim 5, wherein the first illumination unit, the second illumination unit and the liquid crystal display panel are stacked in the named order.

7. The liquid crystal display device of claim 6, wherein the first light source is disposed along a first short side of the first light guide, and the second light source is disposed along a second short side of the second light guide at a position not overlapping the first light source.

* * * * *